US006494787B1

(12) United States Patent
Bork et al.

(10) Patent No.: US 6,494,787 B1
(45) Date of Patent: Dec. 17, 2002

(54) CHILDREN'S STAND UP SPINNER RIDE

(75) Inventors: Frank Bork, Bedford, PA (US); Steven Hanson, North Kingstown, RI (US)

(73) Assignee: Hedstrom Corporation, Bedford, PA (US)

( * ) Notice: Subject to any disclaimer, the term of this patent is extended or adjusted under 35 U.S.C. 154(b) by 0 days.

(21) Appl. No.: 10/039,592

(22) Filed: Oct. 22, 2001

(51) Int. Cl.[7] ..... A63G 1/12
(52) U.S. Cl. ..... 472/16; 472/118; 472/32
(58) Field of Search ..... 472/29, 39, 32, 472/33, 34, 118, 119, 131, 59, 14, 18; 482/35, 36

(56) References Cited

U.S. PATENT DOCUMENTS 832,800 A * 10/1906 Mercer ..... 187/267
1,774,280 A 8/1930 Long
1,890,353 A * 12/1932 Anderson ..... 472/17
2,532,444 A * 12/1950 Germana ..... 297/344.13
3,614,084 A * 10/1971 Brown ..... 267/153
3,713,251 A 1/1973 Marason, Jr.
5,658,200 A * 8/1997 Ellis ..... 472/18

* cited by examiner

*Primary Examiner*—Kien T. Nguyen
(74) *Attorney, Agent, or Firm*—Cesari and McKenna LLP

(57) ABSTRACT

A children's play ride includes an elongated rigid vertical pole having an exterior surface and an elongated tubular housing with an inner surface snugly encircling the pole, the housing being moveable along the pole between an upper position and a lower position. The housing includes a support for a child and co-acting parts on the pole and the housing cause the housing to rotate about the pole only when the housing is moved from the upper position toward the lower position.

9 Claims, 2 Drawing Sheets

CHILDREN'S STAND UP SPINNER RIDE

This invention relates to a children's play ride. It relates especially to a ride which is adapted to be associated with a children's swing set, play gym or the like.

BACKGROUND OF THE INVENTION

A typical children's swing set or gym set usually includes a variety of different play rides such as swings, slides, rings, glide-rides, see-saws and the like which involve up and down and back and forth movements of the children using the various rides. To our knowledge, the swing and gym sets on the market today do not include any rides which produce a helical spinning motion. It would be desirable, therefore, to be able to offer a swing set with a ride which will accommodate at least one child standing up and automatically helically spin that child about a vertical axis.

SUMMARY OF THE INVENTION

Accordingly it is in object to the present invention to provide a children's play ride which can automatically rotate at least one child about a substantially vertical spin axis.

Another object of the invention is to provide a spinner ride of this type which is gravity operated.

Yet another object of the invention is to provide such a spinner ride which is especially adapted to be connected to a more or less conventional children's swing or gym set.

Another object of the invention is to provide a children's spinner ride which is relatively easy to manufacture and to assemble.

Other objects will, in part, be obvious and will, in part, appear hereinafter.

The invention accordingly comprises the features of construction, combination of elements and arrangement of parts which will. be exemplified in the following detailed description, and the scope of the invention will be indicated in the claims.

Briefly, our spinner ride comprises a rigid elongated pole whose upper end is adapted to be connected to the cross bar of a children's gym set and whose lower end is arranged to contact the ground so that the pole stands erect. The pole is formed with at least one, and preferably a plurality, of depressions or pockets at an elevated location on the pole, the plurality of depressions being distributed around the pole and being offset along the pole. Slideably engaged on the pole is a spinner comprising an elongated tubular housing having handles at the upper end of the housing and a footrest at the lower end thereof. A lengthwise segment of the housing is formed with an internal spiral groove and a relatively large ball bearing is positioned in each pocket of the pole. The bearings, pockets and grooves are specially dimensioned and shaped so that when the housing is lifted up on the pole, the ball bearings are situated entirely within their pockets so that there is clearance between the ball bearings and the inner wall of the housing allowing the housing to be raised up on the pole until the lower end of the grooved segment of the housing is opposite the ball bearings.

On the other hand, when there is no upward force exerted on the housing, the ball bearings under gravity tend to repose at the bottoms of their pockets so that when a downward force is applied to the housing, portions of the ball bearings project into the housing groove whereby the housing is caused to rotate about the pole as the housing moves downward on the pole.

Thus, after a child lifts the spinner on the pole as described above, he/she may step on the footrest while holding onto the handles. The weight of the child combined with the engagement of the ball bearings in the housing groove will cause the spinner and the child to rotate about the pole until spinner reaches the bottom of its downward excursion on the pole.

Our spinner ride is capable of accommodating one or two children. While it is described herein as being associated with a children's swing set, it could just as well be supported vertically by another type of support structure.

Also as will become apparent hereinafter, the spinner ride is a relatively simple structure which can be made and assembled quite easily. Therefore, it should prove to be a very marketable item of play equipment.

BRIEF DESCRIPTION OF THE DRAWINGS

For a fuller understanding of the nature and objects of the invention, reference should be made to the following detailed description taken in connection with the accompanying drawings, in which.

DESCRIPTION OF THE PREFERRED EMBODIMENT

Figure 1:
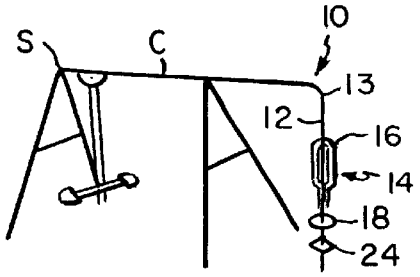
FIG. 1 is a isometric view of a children's swing set including a children's stand up spinner ride incorporating this invention.

Refer now to FIG. 1 of the drawings which shows a conventional children's swing set S having a crossbar C. Extending from the right-hand end of swing set S is a children's stand up spinner ride shown generally at 10.

The spinner ride 10 includes a vertical, rigid, elongated pole 12 whose upper end is connected by an elbow 13 to an end of crossbar C so that pole 12 is oriented vertically.

Slideably and rotatably engaged on pole 12 is an elongated spinner shown generally at 14. The spinner is formed with a pair of handles or grips 16 at its upper end and a discoid footrest 18 at its lower end. When the spinner is raised up on pole 12 and subjected to a downward force, e.g. gravity, the spinner will rotate as it moves downward relative to the pole. Thus, when the spinner 14 is in its raised position and a child stands on footrest 18 while holding handles 16, the weight of the child will cause spinner 14 to rotate about the pole as the spinner moves downward on the pole. Resultantly, the rider is spun around the pole as long as the downward motion of the spinner persists.

Figure 2:
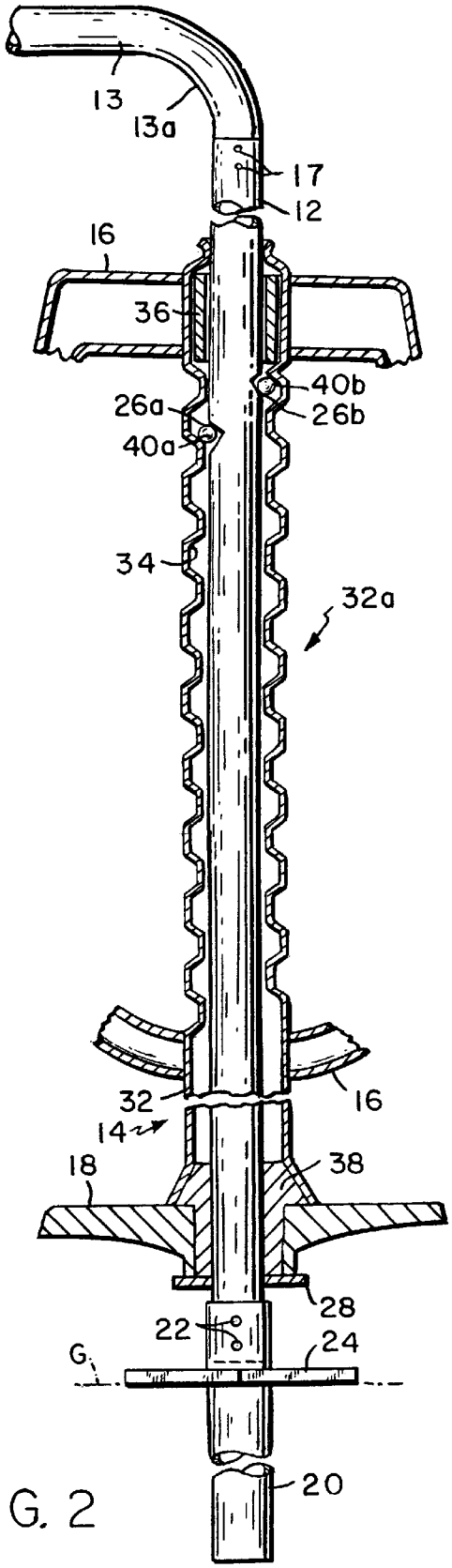
FIG. 2 is a vertical sectional view on a much larger scale showing the spinner ride in greater detail.
Figure 4:
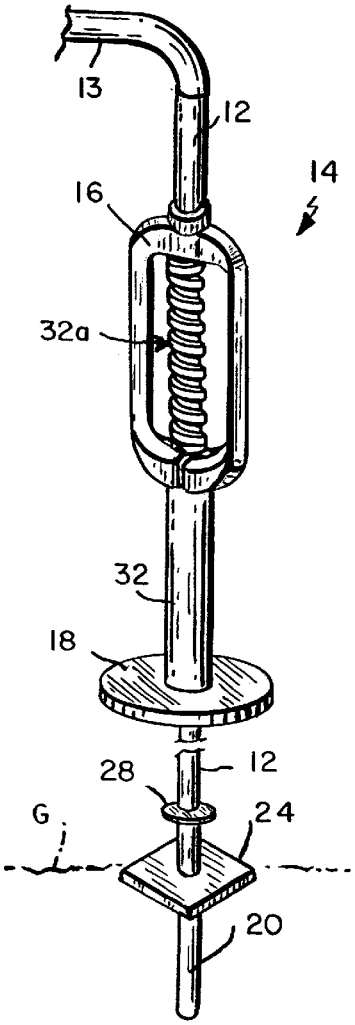
FIG. 4 is a perspective view of the spinner ride in its raised reset condition.

Referring now to FIGS. 2 and 4, the elbow 13 has a lower end 13*a* which is plugged into the upper end of pole 12 and retained there by a fastener 17. In like manner, the lower end of pole 12 is plugged into the upper end of a tubular extension 20 and retained there by fasteners 22. Extension 20 is adapted to be inserted into the ground G as shown in FIG. 2, the insertion limit being determined by a plate 24 secured to extension 20. For reasons that will become apparent, pole 12 is formed with a pair of specially shaped pockets or depressions 26*a* and 26*b* adjacent to the upper end of the pole. These pockets are disposed on opposite sides of pole 12 and are offset axially along the pole as shown in FIG. 2 so that an imaginary line between them defines an angle of about 45° relative to the horizontal. Also, for reasons that will become apparent, a large washer 28 is secured to pole 12 adjacent to the lower end thereof.

Still referring to FIGS. 2 and 4, spinner 14 comprises an elongated tubular housing 32 which encircles pole 12. The opposite ends of handles 16 are secured to housing 12 and a relatively long segment 32*a* of housing 12 that extends between the upper and lower ends of handles 16 is formed so as to define an internal spiral groove or race 34. As best seen in FIG. 2, the upper end of housing 32 is crimped around a sleeve 36 which is slideably engaged on pole 12. On the other hand, the lower end of the housing is formed around a bushing 38 to which the footrest 18 is attached. The sleeve 36 and bushing 38 allow smooth rotary and vertical motion of spinner 14 relative to pole 12.

Spinner 14 is moveable up and down on pole 12 between an elevated position shown in FIG. 4 wherein the lower end of housing segment 32*a* is located opposite pockets 26*a*, 26*b* in pole 12 and a lower position illustrated in FIG. 2 wherein the upper end of segment 32*a* is positioned opposite those pockets. The engagement of bushing 38 against the washer 28 positively establishes that lower position.

In accordance with the invention, the pockets 26*a*, 26*b* contain a pair of loose ball bearings 40*a* and 40*b*. The pockets, bearings and housing groove 34 are dimensioned and shaped to disengage the ball bearings 40*a*, 40*b* from groove 34 when housing 32 is moved upward on pole 12 and to engage those bearings in groove 34 when the housing is moved downward relative to pole 12.

Figure 6:
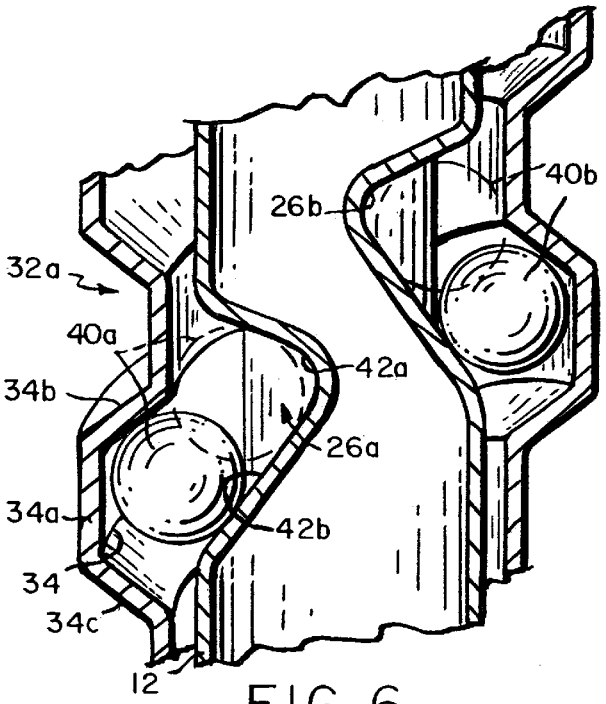
FIG. 6 is a fragmentary sectional view further illustrating the operation of the spinner ride.

More particularly and referring especially to FIG. 6, each pocket 26*a*, 26*b* has an upper portion 42*a* which is relatively deep, with the depth being comparable to the diameter of the ball bearings 40*a*, 40*b*. Each pocket also has a lower inclined portion 42*b* which extends from portion 42*a* downward on pole 12 to the outer surface of the pole.

Figure 3:
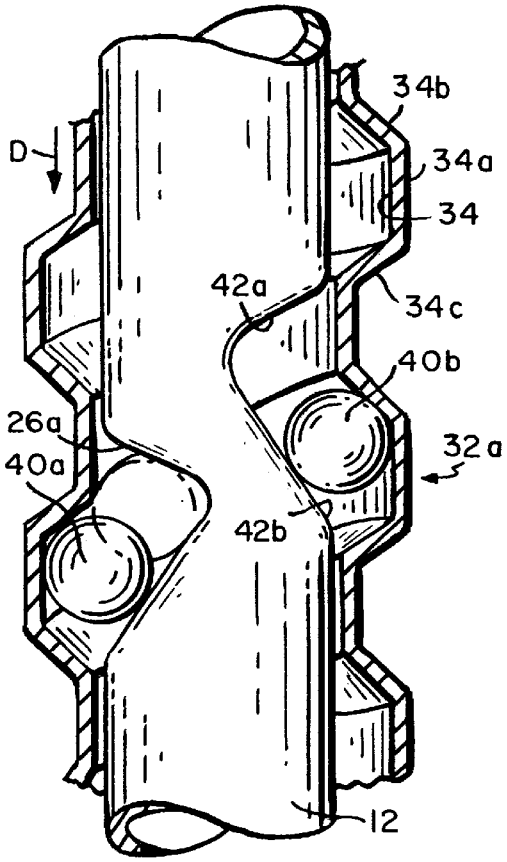
FIG. 3 is a fragmentary sectional view on a still larger scale illustrating a portion of the spinner ride during its spinning movement.

While the spiral groove 34 in the housing segment 32*a* may have a semispherical cross-section, the illustrated groove has a generally trapezoidal cross-section. In other words, groove 34 has a side wall 34*a* which extends generally parallel to pole 12 and indined upper and lower walls 34*b* and 34*c*, respectively, which extend away from one another making angle of about 45° relative to wall 34*a*. The pockets 26*a*, 26*b* are offset axially on pole 12 by substantially the same amount as the convolutions of groove 34, i.e. the offset substantially equals the groove pitch. Resultantly, when housing 32 is urged downward relative to pole 12 in a direction shown by the arrow D in FIG. 3, the ball bearings 36*a*, 36*b* fall under gravity to the lower or shallow portion 42*b* of their respective pockets 26*a*, 26*b* with the result that the ball bearings project out from pole 12 into groove 34 and are in position to be engaged by the upper wall 34*b* of groove 34. With the bearings so positioned, when spinner 14 is urged downward on pole 12, the groove wall 34*b* will rotate past the stationary ball bearings causing a rotation of the housing 32 relative to the pole 12. It should be understood that the bearings 40*a*, 40*b* are quite large, e.g. at least 0.75 inch in diameter so as to distribute forces over relatively large areas thereby enabling the housing to spin readily about pole 12 even if a relatively heavy child is standing on footrest 18.

Figure 5:
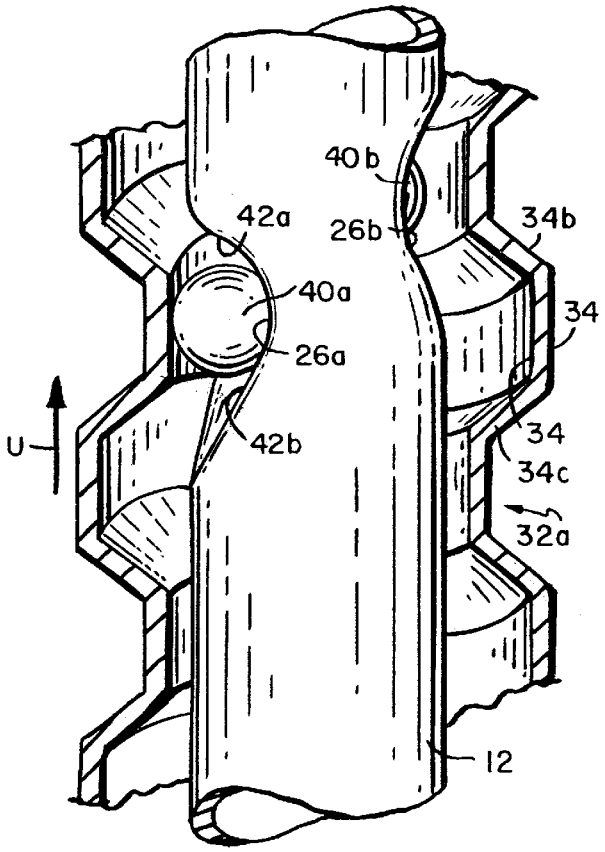
FIG. 5 is a view similar to FIG. 3 showing the components of the spinner ride in the FIG. 4 reset condition.

On the other hand, when the housing 32 is moved upward relative to pole 12 as indicated by the arrow U in FIG. 5, the ball bearings 40*a*, 40*b* are engaged by the lower wall 34*c* of groove 34 which lifts them up to the deep portion 42*a* of pockets 26*a*, 26*b* thereby allowing the housing segment 32*a* to slide past the ball bearings without any rotation of the housing. Thus, the spinner 14 can be raised from its lower position shown in FIGS. 1 and 2 to its elevated position illustrated in FIG. 4 without causing any rotation of the spinner about pole 12. On the other hand when spinner 14 is moved downward on pole 12, the engagement of the ball bearings 26*a*, 26*b* in groove 24 constrains the spinner 14 and its rider to rotate about pole 12.

In order to use ride 10, a child should raise spinner 14 to its upper position shown FIG. 4 and then step on the footrest 18 while holding onto a handle 16. The upper position of the spinner may be limited by a stop screw (not shown) threaded into pole 12. The weight of the child will automatically engage the ball bearings 40, 40*b* in the housing groove 24 so that the downward force on spinner 14 will cause the spinner and its occupant to rotate about pole 12 as the spinner moves toward the lower end of pole 12. When the spinner bottoms against washer 28, it may continue to rotate a few turns due to inertia At that point, the child will have to step off footrest 18 and reset the spinner to its upper position in order to initiate another spin ride.

As seen from the foregoing, the major components of the ride 10 are relatively simple parts which may be stamped metal parts or molded plastic parts that are inexpensive to make in quantity and are easy to assemble. Therefore, including the ride 10 with a standard children's swing set does not add appreciably to the overall cost of that set.

It will thus be seen that the objects set forth above among those made apparent from the preceding description are efficiently attained. Also, certain changes may be made in the above construction without departing from the scope of the invention. For example, the number and size of the pole and race-engaging ball bearings may vary depending upon the weight of the riders. Therefore, it is intended that all matter contained in the above description or shown in the accompanying drawings shall be interpreted as illustrative and not in a limiting sense.

What is claimed is:

1. A children's play ride comprising:

an elongated rigid pole having an exterior surface;

means for supporting the pole vertically;

an elongated tubular housing having an inner surface snugly encircling the pole, said housing being moveable along the pole between an upper position and a lower position;

means on the housing for supporting a child, and co-acting means on the pole and the housing which cause the housing to rotate about the pole only when the housing is moved from said upper position toward said lower position.

2. The play ride defined in claim 1 wherein the housing has upper and lower ends, and the supporting means include a footrest at the lower end of the housing and a hand grip at the upper end of the housing.

3. The play ride defined in claim 1 wherein the co-acting means include at least one depression in the surface of said pole;

a groove inscribed in said inner surface of the housing, and at least one bearing element received in said depression and engaging in said groove when the housing is moved from said upper position toward said lower position and disengaging from the groove when the housing is moved from said lower position toward said upper position.

4. A children's play ride comprising an elongated rigid pole having a wall;

a plurality of pockets in said wall, said pockets being distributed around and displaced axially along the pole;

an elongated tubular housing snugly encircling said pole, said housing including first and second ends and a longitudinal segment between said ends which defines an internal helical race facing said pole;

means on the housing for supporting a child;

a plurality of ball bearings received in said plurality of pockets, said pockets, bearings and race being shaped and dimensioned such that when the housing is urged in one direction along the pole, the bearings engage in said race and cause the housing to rotate about the pole and when the housing is urged in an opposite direction along the pole, the bearings disengage from the race so that there is no rotation of the housing about the pole.

5. The play ride defined in claim 4 wherein said race has a semispherical or trapezoidal cross-section.

6. The play ride defined in claim 4 wherein said pole has two pockets which are offset so that an imaginary line between them makes an included angle of about 45° with said pole.

7. The play ride defined in claim 4 and further including means for supporting the pole vertically so that said one direction is downward and said opposite direction is upward.

8. The play ride defined in claim 4 wherein said ball bearings each have a diameter of at least 0.75 inch.

9. The play ride defined in claim 4 wherein said supporting means include a foot support at said first end of the housing and at least one hand grip at said second end of the housing.

* * * * *